US012290173B2

(12) United States Patent
Bruder et al.

(10) Patent No.: US 12,290,173 B2
(45) Date of Patent: May 6, 2025

(54) FITTING FOR A HEIGHT-ADJUSTABLE TABLE AND HEIGHT-ADJUSTABLE TABLE

(71) Applicant: Veyhl GmbH, Neuweiler (DE)

(72) Inventors: Wolfgang Bruder, Simmersfeld (DE); Horst Schober, Neuweiler (DE)

(73) Assignee: Veyhl GmbH, Neuweiler (DE)

( * ) Notice: Subject to any disclaimer, the term of this patent is extended or adjusted under 35 U.S.C. 154(b) by 573 days.

(21) Appl. No.: 17/653,340

(22) Filed: Mar. 3, 2022

(65) Prior Publication Data

US 2022/0312954 A1 Oct. 6, 2022

(30) Foreign Application Priority Data

Mar. 31, 2021 (DE) ..... 10 2021 203 311.3

(51) Int. Cl.
*A47B 9/08* (2006.01)
*A47B 13/02* (2006.01)

(52) U.S. Cl.
CPC ..... *A47B 9/08* (2013.01); *A47B 13/023* (2013.01); *A47B 2200/0086* (2013.01)

(58) Field of Classification Search
CPC .. A47B 9/00; A47B 9/08; A47B 9/083; A47B 9/16; A47B 9/18; A47B 2009/003; A47B 2200/0086; F16B 2/06; F16B 2/10; F16B 2/18; F16B 1/00; F16B 1/02; F16B 1/04; F16B 21/02; F16B 21/20
See application file for complete search history.

(56) References Cited

U.S. PATENT DOCUMENTS

| | | | | |
|---|---|---|---|---|
| D1,033,087 S * | 7/2024 | Bruder | ..... | D6/686 |
| 2004/0060484 A1* | 4/2004 | Leith | ..... | A47B 96/02 108/42 |

FOREIGN PATENT DOCUMENTS

| | | | | |
|---|---|---|---|---|
| CH | 181126 A | 11/1935 | | |
| DE | 27 29 880 A1 | 1/1979 | | |
| DE | 29600203 U1 * | 4/1996 | | |
| DE | 199 14 184 A1 | 10/2000 | | |
| DE | 20 2006 009 070 U1 | 8/2006 | | |
| DE | 20 2013 008 627 A1 | 10/2013 | | |
| FR | 2 829 808 A1 | 3/2003 | | |
| FR | 2911483 A1 * | 7/2008 | ..... | A47B 9/08 |
| WO | WO-2006101279 A1 * | 9/2006 | ..... | A47B 83/04 |

* cited by examiner

*Primary Examiner* — Jonathan P Masinick
(74) *Attorney, Agent, or Firm* — Orbit IP, LLP; Marc G. Martino

(57) ABSTRACT

A fitting for clamping a table top at different heights to a, preferably obliquely aligned, column extending through the fitting, includes a first and a second fitting part each having an abutment section for abutment against the column from opposite directions, at least one clamping part movable into a release position and a clamping position, and an actuating element movable relative to the fitting parts for moving the clamping part between the release position and the clamping position. Furthermore, this relates to a height-adjustable table having a table frame with a, preferably obliquely aligned, column, a table top, and said fitting arranged at the table top.

15 Claims, 6 Drawing Sheets

FITTING FOR A HEIGHT-ADJUSTABLE TABLE AND HEIGHT-ADJUSTABLE TABLE

CROSS-REFERENCE TO RELATED APPLICATIONS

This application claims priority to German Patent Application No. 10 2021 203 311.3, filed Mar. 31, 2013, the entire contents of which are hereby incorporated in full by this reference.

DESCRIPTION

Field of the Invention

The invention relates to a fitting for clamping a table top to a column extending through the fitting. The invention further relates to a height-adjustable table comprising a table frame with a column and a table top.

Background of the Invention

Such a fitting and such a table are known from DE 20 2013 008 627 U1.

The side table known from DE 20 2013 008 627 U1 consists of a base plate, a rod mounted thereon and a table top movable on the rod. A flange is attached to the table top. Two brake shoes are mounted in the flange. The brake shoes are arranged so that the table top can be adjusted in height as soon as it is tilted against the force of gravity. The table top is suspended off-center on the rod so that the table top's own weight provides the contact pressure necessary for fixing by clamping. A pressure spring can be mounted in the flange to press the table top back into the clamping after adjustment.

With this type of clamping of the desk top to the rod, however, there is a risk that when the desk top is bumped from below, the clamping effect is cancelled, so that the desk top can sag.

Height-adjustable desks with manually or power-assisted telescoping legs are also widely known. However, these are generally relatively heavy, structurally complex and correspondingly expensive.

SUMMARY OF THE INVENTION

Object of the Invention

It is an object of the invention to enable a simple and quick height adjustment of a table top which can be securely fixed.

DESCRIPTION OF THE INVENTION

This object is solved according to the invention by a fitting with the features indicated in the first independent claim and a table according to a dependent claim.

Fitting According to the Invention:

The fitting according to the invention is used to clamp a table top at different heights to a column extending through the fitting. The column is preferably aligned at an angle, i.e. inclined relative to the vertical. The fitting thereby causes a horizontal alignment of the table top in the clamped state. The fitting makes it possible to fix the table top at different heights (positions) on the column and to release the clamping for adjusting the height of the table top.

The fitting has a first fitting part and a second fitting part. The fitting parts each have a abutment section for abutment against the column. The abutment sections of the two fitting parts are arranged for abutting with the column from different directions on the fitting parts. For example, one of the abutment sections may be adapted to abut the column from the rear (as viewed from a user of a table having the fitting) and the other of the abutment sections may be adapted to abut the column from the front. The two abutment sections may each have a friction lining. The friction lining increases the friction between the fitting parts and the column.

The two fitting parts can be rigidly connected to the table top. In particular, they may be insertable into an opening of the table top from different directions (for example, from above and from below). Preferably, the two fitting parts can be directly connected to each other, in particular detachably connected to each other. The two fitting parts can be screwed together.

For use of a table with the fitting, the two abutment sections, in particular the friction linings, are in contact with the column. The table top is thus frictionally held against the column. To adjust the height of the table top, the abutment sections are removed from the column by tilting the table top. The table top with the fittings can then be moved continuously on the column.

The fitting further comprises at least one clamping part. The at least one clamping part can be moved into a release position and a clamping position. Between the release position and the clamping position, the at least one clamping part can typically move by a few millimeters, for example between 4 mm and 8 mm. In the release position of the at least one clamping part, the fitting allows the column to pass through while spacing the abutment sections from the column. Thus, the height of a table top of a table can be adjusted with the fitting when the at least one clamping part is in the release position. In the clamping position, the at least one clamping part forces the abutment sections to bear against the column. Adjusting the height of the table top is therefore not possible when the at least one clamping part is in the clamping position. When the clamping part is in the clamping position, it is ensured in particular that the height of the table top is not inadvertently adjusted, for example if the table top is bumped from below. A table with the fitting according to the invention is therefore particularly safe to use.

In the clamping position, the at least one clamping part may itself abut against the column to force the abutment sections to abut against the column. For a particularly secure fixation, the at least one clamping part may comprise a friction lining.

Preferably, the fitting has a first clamping part for the first fitting part and a second clamping part for the second fitting part. In the clamping position, each of the two clamping parts can ensure that the abutment section of the respectively associated fitting part cannot be lifted off from the column. By using two clamping parts, the fitting can be fixed particularly securely and reliably to the column.

The fitting also has an actuating element for moving the at least one clamping part between the release position and the clamping position. The actuating element is movable relative to the fitting parts for this purpose. The actuating element and the clamping part may be rigidly connected to each other. In particular, the actuating element and the clamping part may be sections of a common component. Preferably, the actuating element and the at least one clamping part are separate components from one another. Typically, the actuating element and the at least one clamping part are movable relative to each other, in particular rotationally and/or translationally. As a principle, the actuating element and the clamping part are motion-coupled to each other. In other words, a movement of the actuating element causes a movement of the clamping part.

The actuating element allows in a simple manner, on the one hand, to lock the fitting for use of a table with the fitting, i.e. to hold the clamping part in the clamping position, and, on the other hand, to make it possible to adjust the height, i.e. to move the clamping part into the release position. The actuating element thus simplifies the safe use of the table with the fitting.

The fitting can be manufactured inexpensively. The components of the fitting can be injection molded parts, in particular plastic injection molded parts. The fitting allows to provide a lightweight and inexpensive height-adjustable table.

The actuating element may be, for example, a lever or a slider. The actuating element may be configured for actuation by a finger, in particular a thumb. Typically, the actuating element is arranged at the first or the second fitting part.

Preferably, a cover is slidably guided on the first fitting part. The cover can from a first clamping part. By moving the cover towards the abutment section of the first fitting part or away from the abutment section of the first fitting part, the fitting can be closed to fix a position on the column, i.e. the first clamping part can be brought into the clamping position, or opened to adjust the position, i.e. the first clamping part can be brought into the release position. By forming the first clamping part by the cover, gaps in the area of the first fitting part can be minimized for the use of a table with the fitting.

A locking mechanism can be provided that holds the clamping part in the clamping position. This can prevent the clamping part from unintentionally moving to the release position. Alternatively, it could be provided that the actuating element is moved over a dead center when the clamping part is moved between the release position and the clamping position.

Particularly preferably, the locking mechanism acts between the actuating element and the cover. When the actuating element is locked to the cover, the cover can additionally be pressed against the column. This causes a particularly firm fixation of the fitting to the column.

Preferably, the fitting has a clamping ring. The clamping ring can form a second clamping part. The clamping ring may have an opening closed on all sides for the passage of the column. The opening is typically in the form of an elongated hole. The clamping ring may surround the column. A component of a translational movement of the clamping ring when moving between the release position and the clamping position may be transverse to the column.

Particularly preferably, the clamping ring is slidably guided on the second fitting part. By displacing the clamping ring towards the abutment section of the second fitting part or away from the abutment section of the second fitting part, the fitting can be closed for fixing a position on the column, i.e. the second clamping part can be brought into the clamping position, or opened for adjusting the position, i.e. the second clamping part can be brought into the release position. The guidance of the clamping ring on the second fitting part enables a particularly compact structure of the fitting. Advantageously, the clamping ring is arranged in an inner space enclosed by the first and second fitting parts.

A bolt can be mounted on the fitting so as to be rotatable about a bolt axis. Preferably, the actuating element interacts with the bolt. In other words, the bolt can be rotated about the bolt axis by actuating the actuating element. The actuating element can be mounted on the fitting via the bolt. Preferably, the actuating element and the bolt are held to each other in a non-rotatable manner with respect to the bolt axis. Preferably, a rotation of the bolt causes a movement of the at least one clamping part between the clamping position and the release position. The bolt makes it possible to set up a coupling of the actuating element with the clamping part, in particular with two clamping parts separate from each other.

Preferably, a bearing seat for the bolt is formed in each of the first and second fitting parts. This allows for a support of the bolt spaced in the axial direction with respect to the bolt axis. The wide support of the bolt increases the rigidity. This is advantageous for holding the at least one clamping part in the clamping position. Where a clamping ring is provided as a clamping part, the clamping ring may have an elongated hole through which the bolt extends.

The bolt may have a terminal bolt portion and an extension spaced from the bolt axis. The terminal bolt portion is typically concentric with the bolt axis. Preferably, the terminal bolt portion and the extension engage a recess of the actuating element. In this way, a positive coupling of the bolt and the actuating element can be achieved so that the bolt can be rotated by means of the actuating element. Separate recesses or a common recess may be provided for the bolt portion and the extension in the actuating element. The projection may extend through the actuating element. In other words, a free end of the extension may protrude beyond the actuating element.

Particularly preferably, the extension engages in an elongated recess of the clamping part, in particular of the first clamping part. The recess extends at least in sections transversely to a direction of movement of the (first) clamping part. In particular, the recess can extend at least in sections transversely to a displacement direction of a cover guided on the first fitting part, which cover forms the first clamping part. When the bolt is rotated, the engagement of the extension arranged eccentrically to the bolt axis causes a displacement of the (first) clamping part. The engagement of the extension in the recess allows the formation of a simple mountable coupling between the bolt and the (first) clamping part.

The bolt and the clamping part, in particular the second clamping part, can cooperate via respective toothed portions. A gear or gear segment may be formed on the bolt. The gear segment may be arranged opposite an eccentric extension of the bolt with respect to the bolt axis. As a result, a counter-rotating movement of the two clamping parts can be achieved when the bolt is rotated. The (second) clamping part can have at least one toothed rack. Preferably, the toothed rack is integrally formed on the (second) clamping part. Via the engagement of the toothed portions, the (second) clamping part can be pressed against the column with great force by a rotation of the bolt.

Particularly preferably, the fitting can be assembled in two mutually mirror-symmetrical configurations. The same components thus make it possible to obtain a fitting for use on a right-hand column or on a left-hand column of a table having two columns and two fittings. For this purpose, the aforementioned components of the fitting are each themselves mirror symmetrical. Symmetry planes of the first and second fitting components as well as, if applicable, of the cover and the clamping ring contain a column axis of a column extending through the fitting. A symmetry plane of the bolt includes the bolt axis. The actuating element may extend substantially in its plane of symmetry. Latching cams of a locking mechanism, bearing seats for the bolt in the fitting parts, an elongated hole in the clamping ring for passing the bolt through, and toothed portions on the clamping ring can each be present in duplicate.

Table According to the Invention:

Also within the scope of the present invention is a height-adjustable table. The table has a table frame with a column. The column extends rectilinearly at least in sections. Preferably, the column is oriented obliquely. In other words, the column may be inclined with respect to the vertical. The table further comprises a table top. A fitting according to the invention, described above, is arranged at the table top. The fitting makes it possible to clamp the table top to the column at different heights (positions) and to release the clamping for adjusting the height of the table top.

The fitting is generally located at an opening in the table top. In particular, the two fitting parts can be inserted into the opening from different sides.

As a principle, the fitting is arranged eccentrically on the table top (away from its center of gravity). The table top's own weight presses the abutment sections of the fitting against the column if the table top is not actively tilted against the effect of gravity. The table top's own weight preferably presses the abutment sections against the column to such an extent that the table top remains at the set height. In other words, pressing the abutment sections against the column is usually sufficient to fix the table top to the column, even when the at least one clamping part is in the release position. The inclined orientation of the column enhances the clamping action (with the same eccentricity of the fitting to the center of gravity of the table top). The fitting is typically adjusted to the inclination of the column in such a way that the table top fixed to the column is aligned horizontally.

When the at least one clamping part is in the release position, the table top can be tilted against the force of gravity and moved along the column to adjust the height. After the table top is released, the height set in this way is held by the frictional connection between the abutment sections of the fitting and the column.

To prevent an (unintentional) change in the height of the tabletop, the at least one clamping part is brought into the clamping position by means of the actuating element. The at least one clamping part preferably abuts directly against the column. In the clamping position, the at least one clamping part forces the abutment sections of the two fitting parts to abut against the column. In particular, the clamping part can prevent the tabletop from tilting in the clamping position.

The column can be a tube, especially a metal tube. The table top may be made of wood or may be made with a wood-based material.

The table according to the invention can be provided at a low cost. Further, the table according to the invention may be relatively lightweight for a height-adjustable table. By means of the fitting according to the invention, on the one hand the height of the table top can be adjusted in a simple manner and quickly, and on the other hand the table top can be reliably fixed at the set height. To change the height, the clamping part is brought into the release position by means of the actuating element, then the table top is tilted (raised) against the effect of gravity and moved to the desired height, finally the clamping part is transferred back into the clamping position by means of the actuating element. This can be done in a few simple steps and in particular without tools or other aids.

For example, the table can be used as a desk, as a side table, as a workbench for handicrafts or the like, or as a dining table. In particular, with multiple table tops, the table can also be used as a shelf.

The table frame may have a further column, and a further fitting for the further column may be arranged at the table top. The two columns can improve the stability of the table. In addition, the two columns can prevent the table top from rotating around the column, even if the column has a circular cross-section. As a principle, an (imaginary) connecting straight line of the fittings does not run through the center of gravity of the tabletop. The two columns usually run parallel to each other, at least in sections.

The table frame may have a support leg. The support leg can further improve the stability of the table. In a table frame with two columns, two support legs are typically provided.

Preferably, the support leg is hingedly connected to the (respective) column. This makes it possible to fold up the table frame for phases of non-use in a space-saving manner.

Preferably, the table top can be pulled off the column when the clamping part is in the release position. This allows the table to be disassembled in a simple manner for storage or transportation.

Further features and advantages of the invention will be apparent from the claims, the description and the drawing. In accordance with the invention, the features mentioned above and those still further elaborated may each be used individually or as a plurality in any suitable combinations. The embodiments shown and described are not to be understood as a conclusive list, but rather have an exemplary character for the description of the invention.

BRIEF DESCRIPTION OF THE DRAWINGS

The invention is illustrated in the drawing and described with reference to embodiments.

DETAILED DESCRIPTION OF THE PREFERRED EMBODIMENTS

Figure 1:
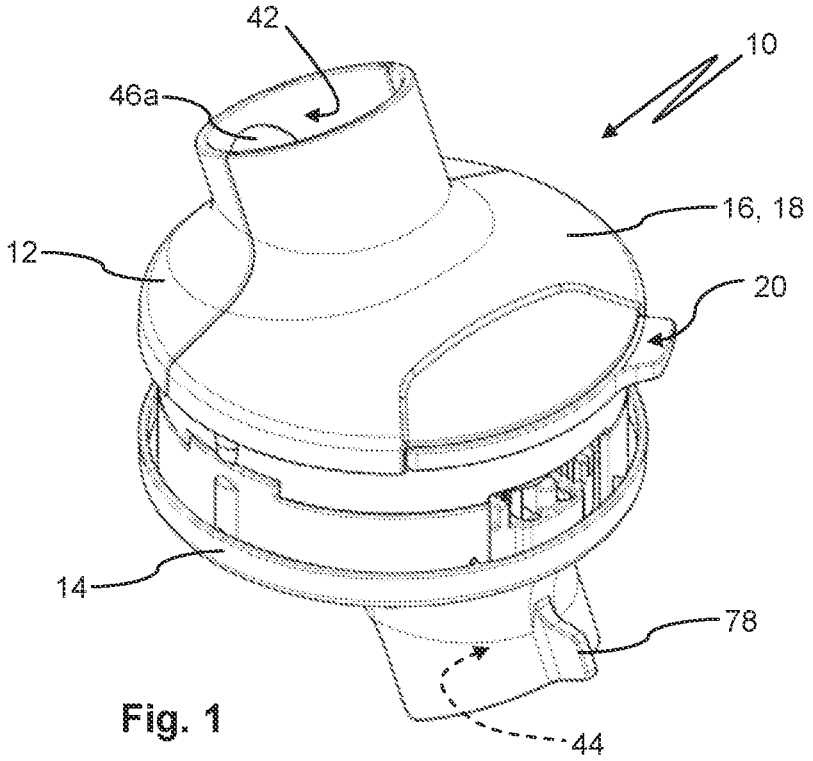
FIG. 1 shows a fitting according to the invention with a first and a second fitting part, wherein a cover forming a first clamping part is in a clamping position, in a schematic perspective view.
Figure 2:
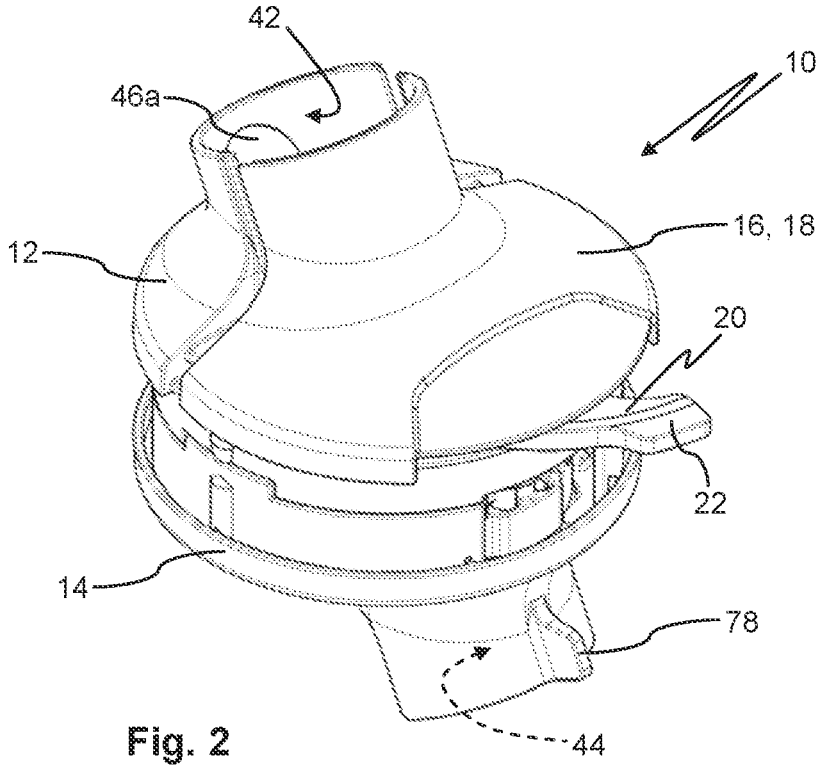
FIG. 2 shows the fitting of FIG. 1, wherein the cover has been transferred to a release position by actuating an actuating element, in a schematic perspective view.

FIGS. 1 and 2 show a fitting 10. In FIG. 1, the fitting 10 is shown in a closed state. In FIG. 2, the fitting 10 is in an open state.

The fitting 10 has a first fitting part 12 and a second fitting part 14. The two fitting parts 12, 14 may be connected to each other via screws not shown in more detail here. The fitting parts 12, 14 can have edge sections for contact with a table top on the upper and lower sides, respectively.

A first clamping part 16 in the form of a cover 18 is displaceably guided on the first fitting part 12. In the closed state of the fitting 10 (compare FIG. 1), the first clamping part 16 is in a clamping position; in the open state of the fitting 10 (compare FIG. 2), the first clamping part 16 is in a release position.

The fitting 10 further comprises an actuating element 20. The actuating element 20 may comprise a protrusion 22 for deflecting the actuating element 20 with fingers of a hand. By actuating the actuating element 20, the first clamping part 16 can be brought into the clamping position or release position.

Figure 3:
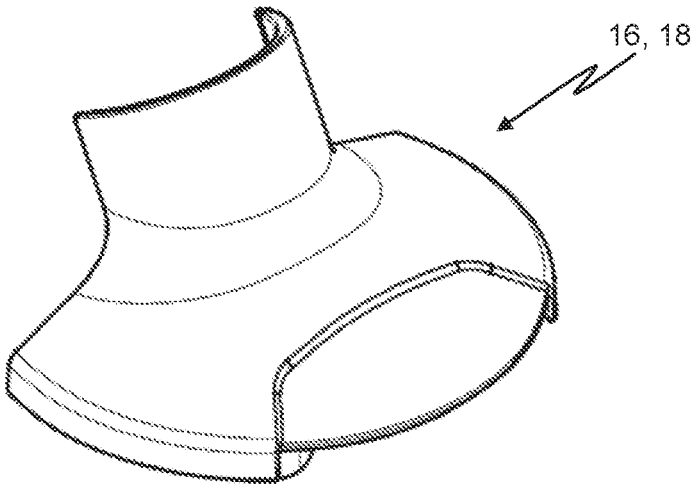
FIG. 3 shows the cover of the fitting of FIG. 1 in an exempted, schematic perspective view.
Figure 4:
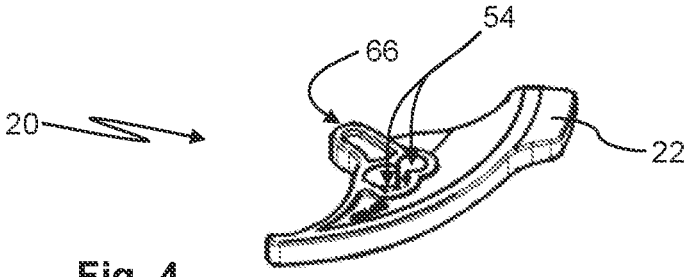
FIG. 4 shows the actuating element of the fitting of FIG. 1 in an exempted, schematic perspective view.
Figure 6:
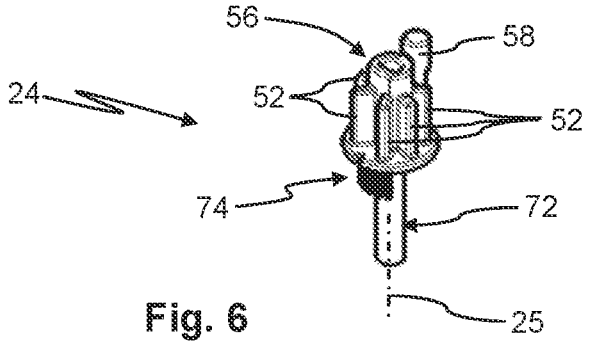
FIG. 6 shows an exempted, schematic perspective view of a bolt of the fitting of FIG. 1 that can be rotated via the actuating element.
Figure 7:
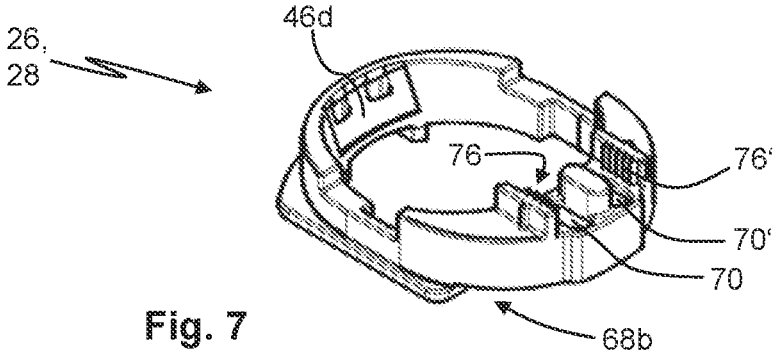
FIG. 7 shows a clamping ring displaceable by a rotation of the bolt, which forms a second clamping part of the fitting of FIG. 1, in an exempted, schematic perspective view.

Individual parts of the fitting 10 are shown below in individual figures. Here show FIG. 3: the cover 18 forming the first clamping part 16, FIG. 4: the actuating element 20, FIG. 5: the first fitting part 14, FIG. 6: a bolt 24, FIG. 7: a second clamping part 26 in the form of a clamping ring 28, FIG. 8: the second fitting part 14.

Figure 9:
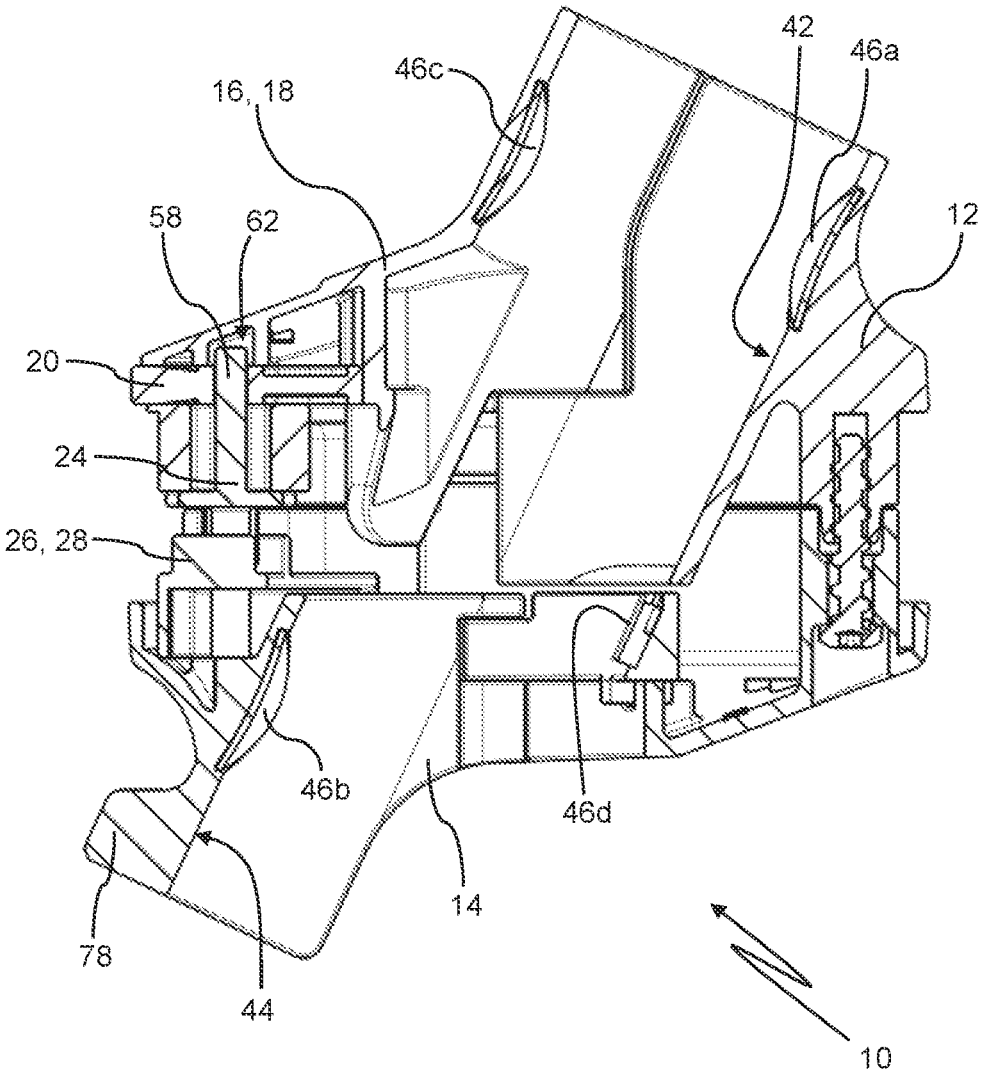
FIG. 9 shows a schematic sectional view through the fitting of FIG. 1.
Figure 10:
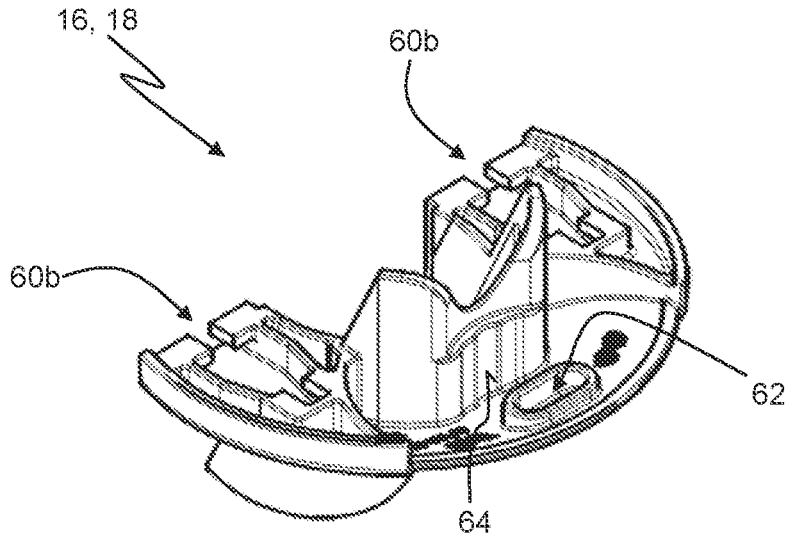
FIG. 10 shows a further schematic perspective view of the cover of the fitting of FIG. 1.

In FIG. 9, the fitting 10 is shown in the closed state (compare FIG. 1) in a sectional view. FIG. 10 shows a further view of the first clamping part 16 formed by the cover 18.

Figure 11:
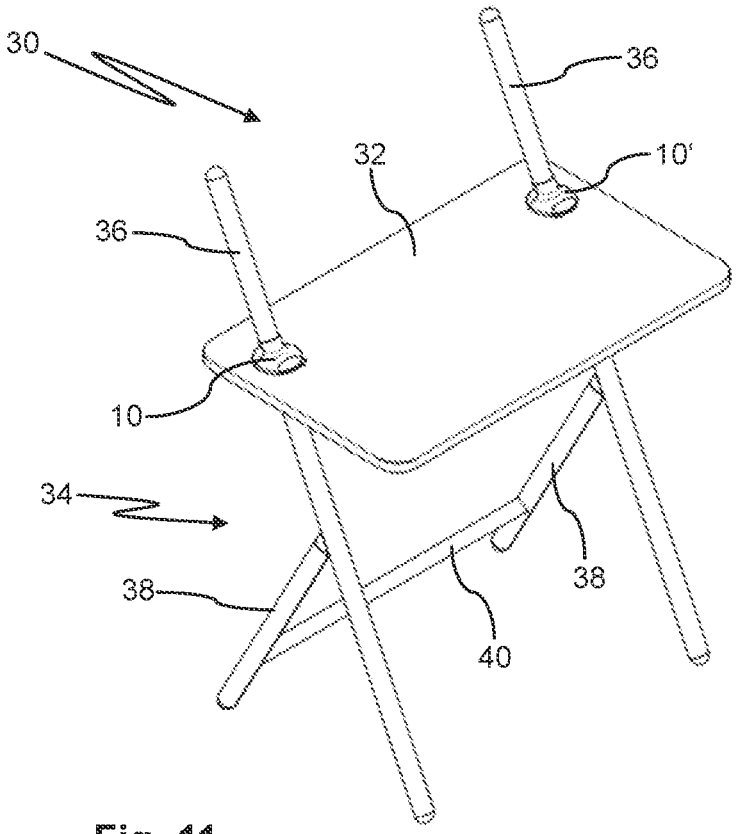
FIG. 11 shows a schematic perspective view of a table according to the invention with two columns, on which a table top is held in a height-adjustable manner by two fittings according to the invention.

FIG. 11 shows a table 30. The table 30 has a table top 32. The table 30 further comprises a table frame 34. The table frame 34 is formed here with two columns 36. The two columns 36 may extend in a generally straight line. The columns 36 extend parallel to each other. In the present embodiment, the columns 36 are oriented at an angle. In the illustrated embodiment of the table 30, a support leg 38 is pivotally hinged to each of the columns 36. In the unfolded state, the support legs 38 hold the columns 36 at the predefined inclination relative to the vertical. The two support legs 38 may be connected to each other by a cross brace 40.

The table top 32 is height-adjustable at the columns 36. Two fittings 10, 10' are inserted in openings in the tabletop 32 for this purpose. The columns 36 extend through the fittings 10, 10'. The two fittings 10, 10' of the table 30 are mirror symmetrical to each other. The individual parts shown in FIGS. 3 to 8 can be assembled in two different configurations to obtain the mirror symmetrical fittings 10, 10'. The assembly condition of the fitting 10 is the same as that of the fitting 10 shown in FIGS. 1, 2 and 9.

For use of the table 30, the table top 32 is clamped to the columns 36. For this purpose, the first and second clamping parts 16, 26 of the fittings 10, 10' are each brought into the clamping position by means of the actuating elements 20. To adjust the height of the table top 32, the first and second clamping parts 16, 26 are each brought into the release position by means of the actuating elements 20. The table top 32 can then be tilted and moved along the columns 36. When the table top 32 is released, it is clamped again to the columns 36 via the fittings 10, 10'. In order to secure the set height, in particular against unintentional adjustment upon contact with the table top 32, the fittings 10, 10' are closed again by means of the actuating elements 20.

The interaction of the individual parts of the fitting 10 or 10' with each other and with the respectively assigned column 36 is described in detail below.

The first fitting part 12 has a first abutment section 42 for abutment against the column 36. The second fitting part 14 has a second abutment section 44 for abutment against the column 36. The abutment sections 42, 44 of the two fitting parts 12, 14 are designed to abut against the column 36 from opposite directions, compare in particular FIG. 9. When the table 30 is in use, the abutment sections 42, 44 contact the column 36 from the rear and the front, respectively. To adjust the height of the table top 32, the abutment sections 42, 44 are lifted off the column 36. The abutment sections 42, 44 may each include a friction lining 46*a*, 46*b*. The friction lining 46*a*, 46*b* may each be a rubber element. The friction linings 46*a*, 46*b* increase the friction between the abutment sections 42, 44 and the column 36.

Figure 5:
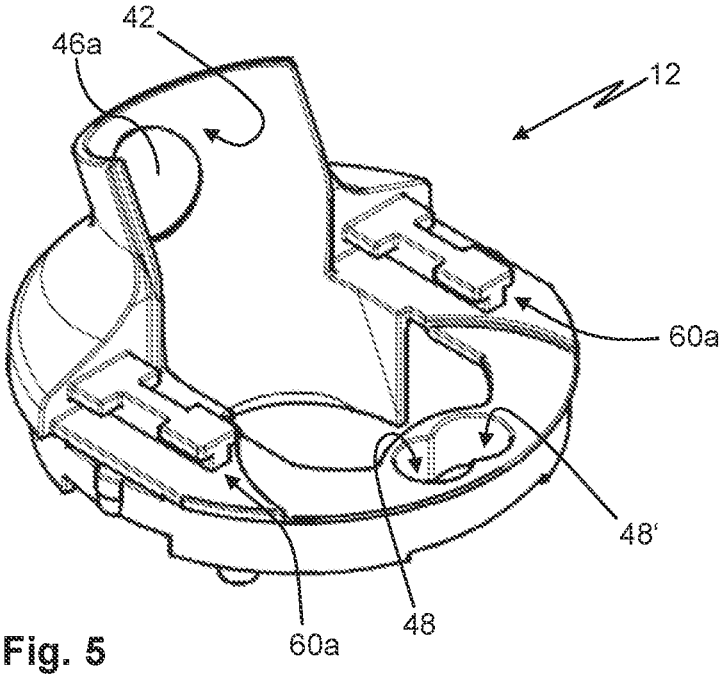
FIG. 5 shows the first fitting part of the fitting of FIG. 1 in an exempted, schematic perspective view.
Figure 8:
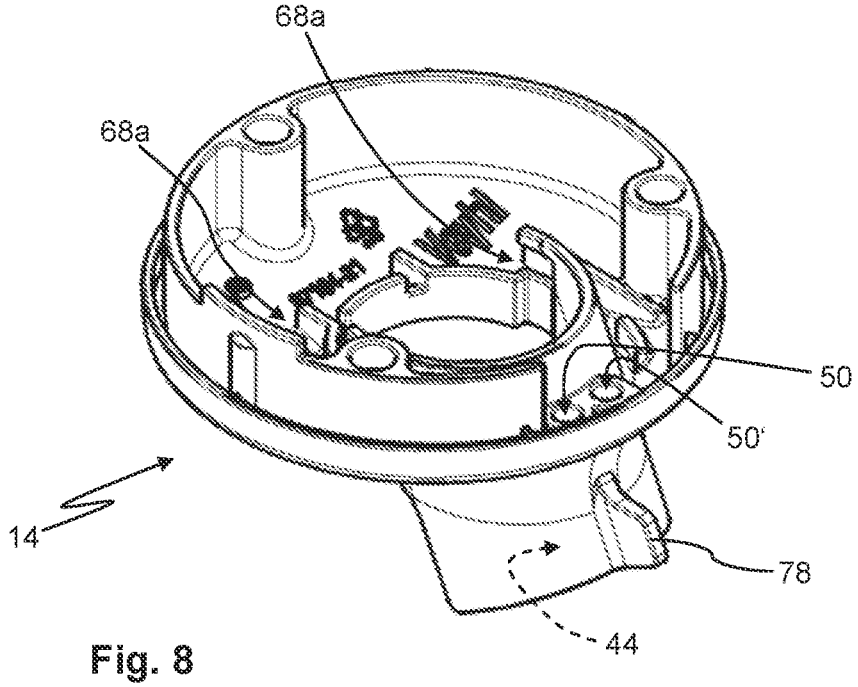
FIG. 8 shows the second fitting part of the fitting of FIG. 1 in an exempted, schematic perspective view.

The first and second fitting parts 12, 14 each have a bearing seat 48, 50 for rotatable mounting of the bolt 24, compare FIGS. 5 and 8. In the present case, a further bearing seat 48', 50' is provided in each case for mirror-inverted mounting of the bolt 24. In the first fitting part 12, the bearing seats 48, 48' are formed by recesses connected to one another. In the second fitting part 14, the bearing seats 50, 50' are formed by recesses separate from one another. For engagement in the bearing seat 48 of the first fitting part 12, radial wall sections 52 can be provided on the bolt 24, compare FIG. 6.

The actuating element 20 is rotationally coupled to the bolt 24. In other words, actuation of the actuating element 20 causes rotation of the bolt 24 about its bolt axis 25. The actuating element 20 (compare FIG. 4) has a non-rotationally symmetrical recess 54, which may be formed with two partial recesses, for engagement or penetration of the bolt 24. The bolt 24 has a terminal bolt portion 56 and an extension 58 offset from the bolt axis 25, compare FIG. 6. The extension 58 may protrude in the axial direction beyond the terminal bolt portion 56. In the assembled state, the terminal bolt portion 56 engages in the recess 54 of the actuating element 20; the extension 58 projects through the recess 54 (compare also FIG. 9).

For the sliding guidance of the cover 18 on the first fitting part 12, guiding devices 60*a*, 60*b* corresponding to one another are formed on the first fitting part 12 and the cover 18, compare FIGS. 5 and 10. The cover 18 can have a further friction lining 46*c* which abuts against the column 36 in the closed state of the fitting 10, i.e. when the first clamping part 16 formed by the cover 18 is in the clamping position, compare FIG. 9.

The first clamping part 16 has an elongated recess 62 which extends transversely to the direction of displacement, compare FIGS. 9 and 10. The eccentric extension 58 of the bolt 24 engages in the elongated recess 62. Thus, rotation of the bolt 24 causes movement of the first clamping part 16 between the clamping position and the release position.

In order to secure the closed state of the fitting 10, a locking mechanism is provided between the actuating element 20 and the cover 18. The cover 18 has a detent contour 64 (compare FIG. 10), which cooperates with a nose 66 of the actuating element 20 (compare FIG. 4). In the closed state of the fitting 10, the nose 66 of the actuating element 20 presses the first clamping part 16 against the column 36.

The clamping ring 28 forming the second clamping part 16 is slidably guided on the second fitting part 14. Guiding devices 68*a*, 68*b* corresponding to one another are formed for this purpose on the second fitting part 14 under the clamping ring 28, compare FIGS. 7 and 8. The clamping ring 28 may have a friction lining 46*d* for contact with the column 36.

The clamping ring 28 has two elongated holes 70, 70' through which a second bolt portion 72 can be guided for engagement with the bearing seats 50 and 50', respectively, in the second fitting part 14.

In order to move the second clamping part 26 (the clamping ring 28) between the release position and the clamping position during a rotation of the bolt 24, the second clamping part 26 and the bolt 24 cooperate via a toothing. A first toothed portion 74 is formed on the bolt 24 in the form of a gear segment. Two second toothed portions 76, 76' in the form of toothed racks are formed on the second clamping part 26 (symmetrically with respect to a center plane). Depending on the assembled configuration of the fitting 10 or 10', the first toothed portion 74 of the bolt 24 interacts with the second toothed portion 76 or 76' of the second clamping part 26.

For assembly of the fitting 10 or 10', the bolt 24 is inserted rotated accordingly. The engagement positions for the bolt 24 in the fitting parts 12, 14 (engagement in the bearing seats 48 and 50 or 48' and 50') as well as the passage through the clamping ring 28 (protruding through the elongated hole 70 or 70') change correspondingly. The actuating element 20 is also placed on the bolt 24 rotated accordingly. Otherwise, there are no differences for the assembly of the fitting 10 or 10'.

Figure 12:
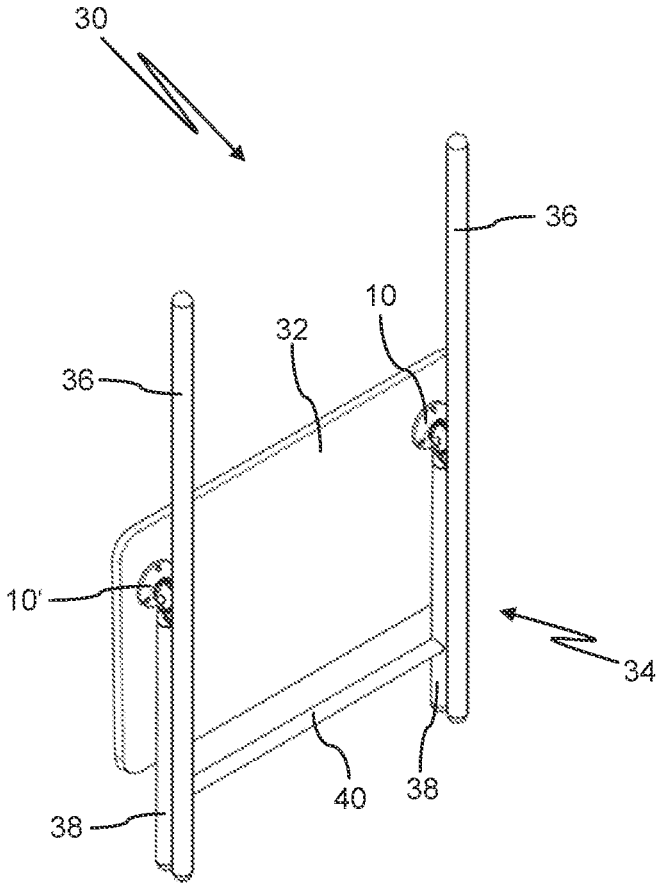
FIG. 12 shows the table of FIG. 11 in a folded state, in a schematic perspective view.

FIG. 12 shows the table 30 in a folded state. The support legs 38 are folded up against the columns 36. The table top 32 is pulled off from the columns 36. The table top 32 can be hooked to the support legs 38 with the aid of hook elements 78. The hook elements 78 are presently formed on the second fitting parts 14, here moulded thereon.

In summary, the invention relates to a fitting for adjusting the height of a table top on a column and to a table with such a fitting. For use of the table, a table top is frictionally held to the column by means of the fitting. To change the height of the table top, the frictional engagement is released by tilting the table top relative to the column. To secure the table top at the set height, at least one clamping part is provided on the fitting. By means of an actuating element, the clamping part can be brought into contact with the column so that tilting of the table top relative to the column is not possible. To allow the height adjustment, the clamping part can be removed from the column by means of the actuating element so that tilting of the table top relative to the column is possible.

LIST OF REFERENCE SIGNS

Fitting 10, 10'
First fitting part 12
Second fitting part 14
First clamping part 16
Cover 18
Actuating element 20
Protrusion 22
Bolt 24
Bolt axis 25
Second clamping part 26
Clamping ring 28
Table 30
Table top 32
Table frame 34
Column 36
Support leg 38
Cross brace 40
First abutment section 42
Second abutment section 44
Friction lining 46*a*, 46*b*, 46*c*, 46*d*
Bearing seat 48, 48', 50, 50'
Wall sections 52
Recess 54
Terminal bolt portion 56
Extension 58
Guiding devices 60*a*, 60*b*
Elongated recess 62
Detent contour 64
Nose 66
Guiding devices 68*a*, 68*b*
Elongated holes 70, 70'
Second bolt portion 72
First toothed portion 74
Second toothed portion 76, 76'
Hook element 78

What is claimed is:

1. A fitting for clamping a table top at different heights to a column or an obliquely aligned column extending through the fitting, the fitting comprising:

a first and a second fitting part, each having an abutment section for abutment against the column from opposite directions;

at least one clamping part movable into a release position and a clamping position; and an actuating element movable relative to the fitting parts for moving the at least one clamping part between the release position and the clamping position;

wherein the actuating element cooperates with a bolt mounted on the fitting to be rotatable about a bolt axis.

2. The fitting according to claim 1, wherein a first clamping part is provided for the first fitting part and a second clamping part is provided for the second fitting part, wherein the at least one clamping part comprises the first and second clamping parts.

3. The fitting according to claim 1, wherein a cover is slidably guided on the first fitting part, wherein the cover forms a clamping part of the at least one clamping part.

4. The fitting according to claim 3, wherein a locking mechanism, which holds the at least one clamping part in the clamping position, acts between the actuating element and the cover.

5. The fitting according to claim 1, wherein a locking mechanism holds the at least one clamping part in the clamping position.

6. The fitting according to claim 1, wherein a clamping ring forms a clamping part of the at least one clamping part.

7. The fitting according to claim 6, wherein the clamping ring is slidably guided on the second fitting part.

8. The fitting according to claim 1, wherein the first and the second fitting part each have a bearing seat for the bolt.

9. The fitting according to claim 1, wherein the bolt has a terminal bolt portion and an extension spaced from the bolt axis, and wherein the terminal bolt portion and the extension engage in a recess of the actuating element.

10. The fitting according to claim 9, wherein the extension engages in an elongated recess of the at least one clamping part.

11. The fitting according to claim 1, wherein the bolt and the at least one clamping part cooperate via respective toothed portions.

12. The fitting according to claim 1, wherein the fitting can be assembled in two mutually mirror-symmetrical configurations.

13. A height-adjustable table, comprising:

a table frame with a column or an obliquely aligned column;

a table top; and the fitting according to claim 1 arranged at the table top.

14. The table according to claim 13, wherein the table frame has a further column and wherein a further fitting for the further column is arranged at the table top.

15. The table according to claim 13, wherein the table frame comprises a support leg which is hingedly connected to the column.

* * * * *